US011511285B2

(12) United States Patent
Chang

(10) Patent No.: US 11,511,285 B2
(45) Date of Patent: Nov. 29, 2022

(54) AUTOFEED PAPER SHREDDER WITH INPUT DRAWER

(71) Applicant: Herman Chang, Rancho Dominguez, CA (US)

(72) Inventor: Herman Chang, Rancho Dominguez, CA (US)

( * ) Notice: Subject to any disclaimer, the term of this patent is extended or adjusted under 35 U.S.C. 154(b) by 225 days.

(21) Appl. No.: 16/786,887

(22) Filed: Feb. 10, 2020

(65) Prior Publication Data

US 2020/0171506 A1 Jun. 4, 2020

Related U.S. Application Data

(63) Continuation of application No. 14/468,235, filed on Aug. 25, 2014, now Pat. No. 10,556,236.

(60) Provisional application No. 61/869,520, filed on Aug. 23, 2013.

(51) Int. Cl.
*B02C 18/00* (2006.01)
*B02C 18/22* (2006.01)

(52) U.S. Cl.
CPC ..... *B02C 18/0007* (2013.01); *B02C 18/2225* (2013.01); *B02C 18/2283* (2013.01); *B02C 2018/2208* (2013.01)

(58) Field of Classification Search
CPC ..... B02C 18/0007; B02C 18/2225; B02C 18/2283; B02C 2018/0015
See application file for complete search history.

(56) References Cited

U.S. PATENT DOCUMENTS

| | | | |
|---|---|---|---|
| 4,192,467 | A | 3/1980 | Hatanaka |
| 4,285,510 | A | 8/1981 | Kanno |
| 4,817,877 | A | 4/1989 | Itoh et al. |
| 4,821,967 | A | 4/1989 | Moriyama |
| 4,842,205 | A | 6/1989 | Araki et al. |
| 4,957,243 | A | 9/1990 | Kanagaki et al. |
| 4,964,579 | A | 10/1990 | Strohmeyer |
| 5,020,733 | A | 6/1991 | Strohmeyer |
| 5,188,301 | A | 2/1993 | Hasegawa |
| 5,354,001 | A | 10/1994 | Hasegawa |
| 5,362,002 | A | 11/1994 | Tsai |
| 5,772,129 | A | 6/1998 | Nishio et al. |
| 5,884,855 | A | 3/1999 | Chang |
| 6,390,397 | B1 | 5/2002 | Ko |
| 6,799,737 | B1 | 10/2004 | Bargert |
| 7,104,481 | B2 | 9/2006 | Schenker |
| 7,871,027 | B2 | 1/2011 | Ko |
| 8,025,246 | B1 | 9/2011 | Brown |
| 8,074,912 | B2 | 12/2011 | Chang |
| 2006/0086847 | A1 | 4/2006 | Schenker |
| 2015/0090818 | A1 | 4/2015 | Matlin et al. |

*Primary Examiner* — Faye Francis
(74) *Attorney, Agent, or Firm* — Matthew J. Spark; Stefan J. Kirchanski; Zuber Lawler LLP

(57) ABSTRACT

An auto-feed paper shredder is configured for placement below the surface of a desk. The auto-feeder consists of a drawer located on the front surface of the shredder. This drawer is slid out to insert a stack of documents to be shredded. When the door is slid back into the shredder and the shredding system is activated, feed rollers draw sheets of paper either from the top or the bottom surface of the stack and feed the sheets into a conventional paper shredding mechanism. An input slot is provided to insert single sheets of paper when the auto-feeder is not being used.

11 Claims, 4 Drawing Sheets

AUTOFEED PAPER SHREDDER WITH INPUT DRAWER

CROSS-REFERENCE TO PRIOR APPLICATIONS

This application is a continuation of U.S. Utility patent application Ser. No. 14/468,235 filed Aug. 25, 2014, which issued as U.S. Pat. No. 10,553,236 on Feb. 11, 2020, which claimed the benefit of U.S. Provisional Patent Application No. 61/869,520, filed on Aug. 23, 2013, both of which are incorporated by reference.

U.S. GOVERNMENT SUPPORT

Not Applicable.

BACKGROUND OF THE INVENTION

Area of the Art

This invention relates to a paper shredder with built-in auto-feed capability that is configured for location beneath a desk.

Description of the Background

Modern paper shredders for shredding documents incorporate counter rotating shafts bearing blades and spacers so that paper passing between the blades is effectively shredded. The maximum sheet capacity of such paper shredders is dependent on the strength of the motor and the limitations of the cutting blades and rotary shafts. Although many units can handle small stacks of 10-20 sheets, when a large amount of paper must be destroyed, the user needs to stand by the unit and continuously feed the machine stacks of paper that are within the maximum sheet capacity of the unit. If even a relatively small number of sheets are to be shredded, it is usually necessary for the user to get up and walk to the shredder because most units must be fed from the top making it difficult or impossible to locate the machine conveniently beneath a desk. For single sheet paper shredders, it is known to place the input slot on the side of the shredder near the top or on a bevel of the upper corner of the shredder so that the unit can be conveniently placed beneath a desk with the input slot just below the underside of the desktop. That is, the input slot is located so as to be accessible when the unit is placed under a desk.

The problem of conveniently shredding large stacks can be solved by paper shredders equipped with an auto-feed mechanism that allows automatic feeding of the paper shredder from large stacks of documents. U.S. Pat. No. 5,362,002, the contents of which are incorporated herein by reference, discloses a paper shredder with automatic paper feeding device The feeding device includes an angled tray which is mounted to the device top adjacent the shredding roller assembly, a rotary shaft which is mounted rotatably on the tray, a tension spring which is connected to the rotary shaft and the tray, and at least one push rod, each rod having two pivotally connected rod sections. The device operates by feeding one or a few sheets of paper from the top of the paper stack in the tray into the throat of the shredder. A similar arrangement is found in U.S. Pat. No. 5,884,855, also incorporated herein by reference, which discloses a paper feed structure for paper shredders having a paper containing tray and paper feed adjustment device. Both of these auto-feeding devices simulate the manual feeding of paper into a shredder and both of them depend on an external tray which increases the overall height and profile of the unit.

What is really needed is a shredder with an integral auto-feed system. A good example is disclosed in U.S. Pat. No. 8,074,912, the content of which is incorporated herein by reference, wherein the paper shredder includes a driving roller assembly at the bottom of a paper compartment and a hinged top for closing the paper compartment and providing downward pressure on the stack of paper located within the compartment. The pivotal driving roller assembly includes a spaced apart pair of counter-rotating feeding rollers which extend through an opening in the bottom of the paper compartment to contact and grab a sheet of paper from the bottom of a stack of paper that has been placed in the compartment. The sheet is grabbed near its center and pulled between the rollers and then pushed into the shredding mechanism. When the compartment is empty, one or more sheets of paper can be pushed through a slot in the hinged top directly between the feeding rollers and into the shredding mechanism. Thus, this unit can function either as an auto-feed unit which shreds a large stack of sheets placed in the compartment or, when the compartment is empty, as a conventional paper shredder by inserting sheets directly into the shredding mechanism.

Although the shredder described in U.S. Pat. No. 8,074,912 is versatile, it cannot be placed below a desk because one needs to swing open the paper compartment doors to insert a stack of paper to be shredded and this would cause the doors to strike the underside of the desk.

SUMMARY OF THE INVENTION

An auto-feed paper shredder is configured to be placed below a desk surface. The device has an input slot on the front surface, on a top bevel at or near the front of the top so that when the unit is slid beneath a desk surface, the input slot is still accessible. In addition, the unit has an input drawer for inputting an entire stack of papers to be processed by an auto-feed system. The drawer can be slid out from the unit and a stack of paper documents loaded therein. When the drawer is slid back into the unit shredding commences.

In one embodiment, the bottom interior surface of the tray is equipped with a biasing plate that becomes depressed when a stack of paper is inserted into the drawer. When the drawer is inserted into the shredder, the biasing plate exerts an upward force on the paper stack thereby bring the paper into contact with a feed roller or belt that draws single sheets of paper, one at a time, off the top of the stack and feeds them into the throat of the shredding mechanism. During the paper feed cycle, the belt or roller temporarily moves into position to contact the upper surface of the paper stack.

In an alternate embodiment the drawer has a slot in its bottom though which the counter-rotating feed rollers pass to contact the bottom sheet of the stack so as to pull paper sheets from the bottom of the stack and feed them into the shredder mechanism. The slot runs the width or length of the sheet and is located near the mid-point of the length or width. The counter-rotating rollers grab the bottom sheet and cause it to fold and be drawn between the rollers. Alternatively, the slot can be located near one of the edges of the sheet. With this configuration, a single sheet is pulled off the bottom of the stack either lengthwise or widthwise and directed into the shredding mechanism without the sheet being folded. The shredder is constructed so that when the feed rollers are in an active contacting position, the drawer is locked in a closed position. When the feed rollers are inactive, they retract and the drawer unlocks so that it can be refilled. When the user desires to withdraw the drawer to insert additional paper, the user presses a switch or a lever that unlocks the catch and simultaneously causes the feed rollers to retract allowing the drawer to be withdrawn.

For optimal operation, the drawer should be equipped with means to uniformly press the stack down onto the feed roller(s). This can be accomplished either by a spring-loaded, hinged bias plate under which the sheets of paper are placed when one loads the drawer or by a mechanically driven pressure plate that descends into the drawer when it is inserted into the shredder.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a paper shredder for placement below a desk surface and including a mechanism to shred sheets of paper pulled from a stack of sheets placed within a drawer integral to the shredder.

Figure 1:
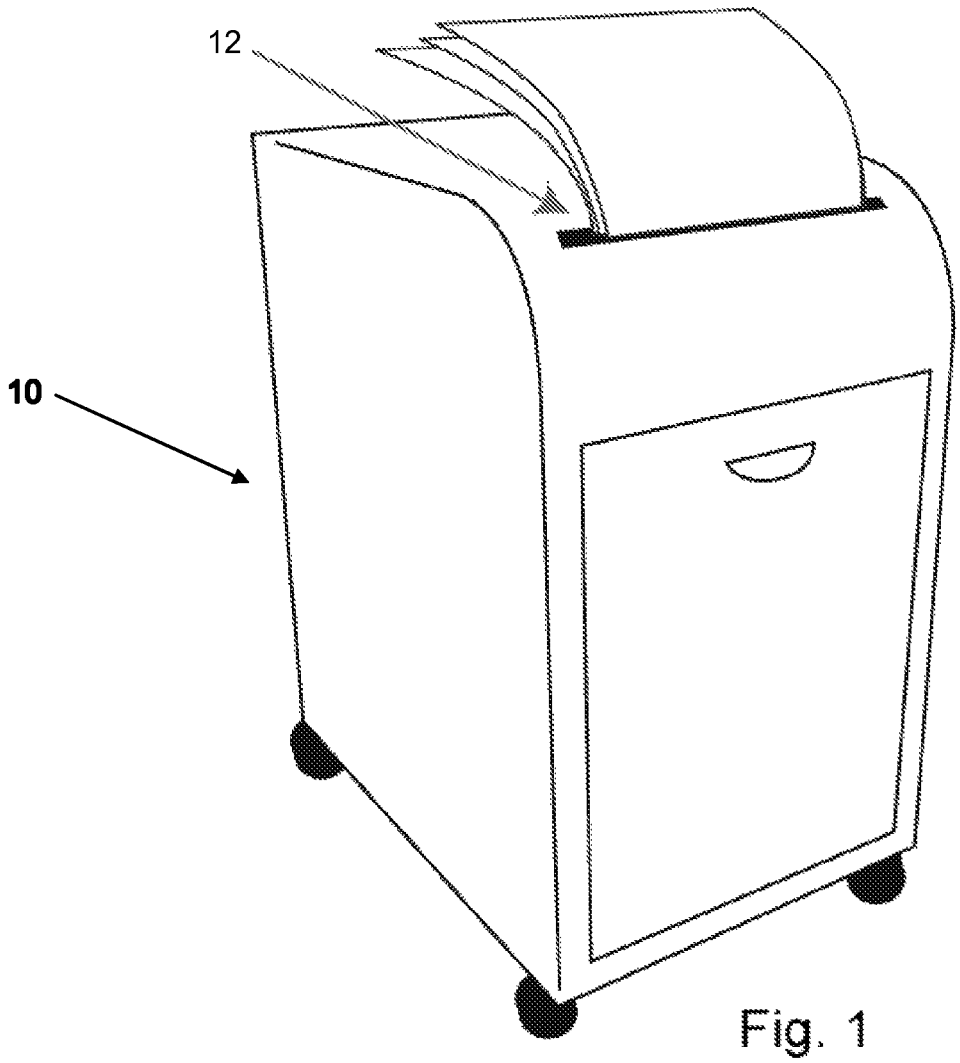
Fig. 1 PRIOR ART
FIG. 1 shows a drawing of a prior art shredder configured for placement below the surface of a desk.

FIG. 1 shows a prior art paper shredder configured for placement below a desk surface. The shredder 10 includes an input slot 12 that is located on either a front surface or a beveled surface which joins the front surface of the unit to the top surface. Traditionally, the input slot 12 would be located on an upper surface of the shredder body, but when a shredder is located below a desk surface, a slot on the upper surface of the shredder is no longer accessible.

Figure 2:
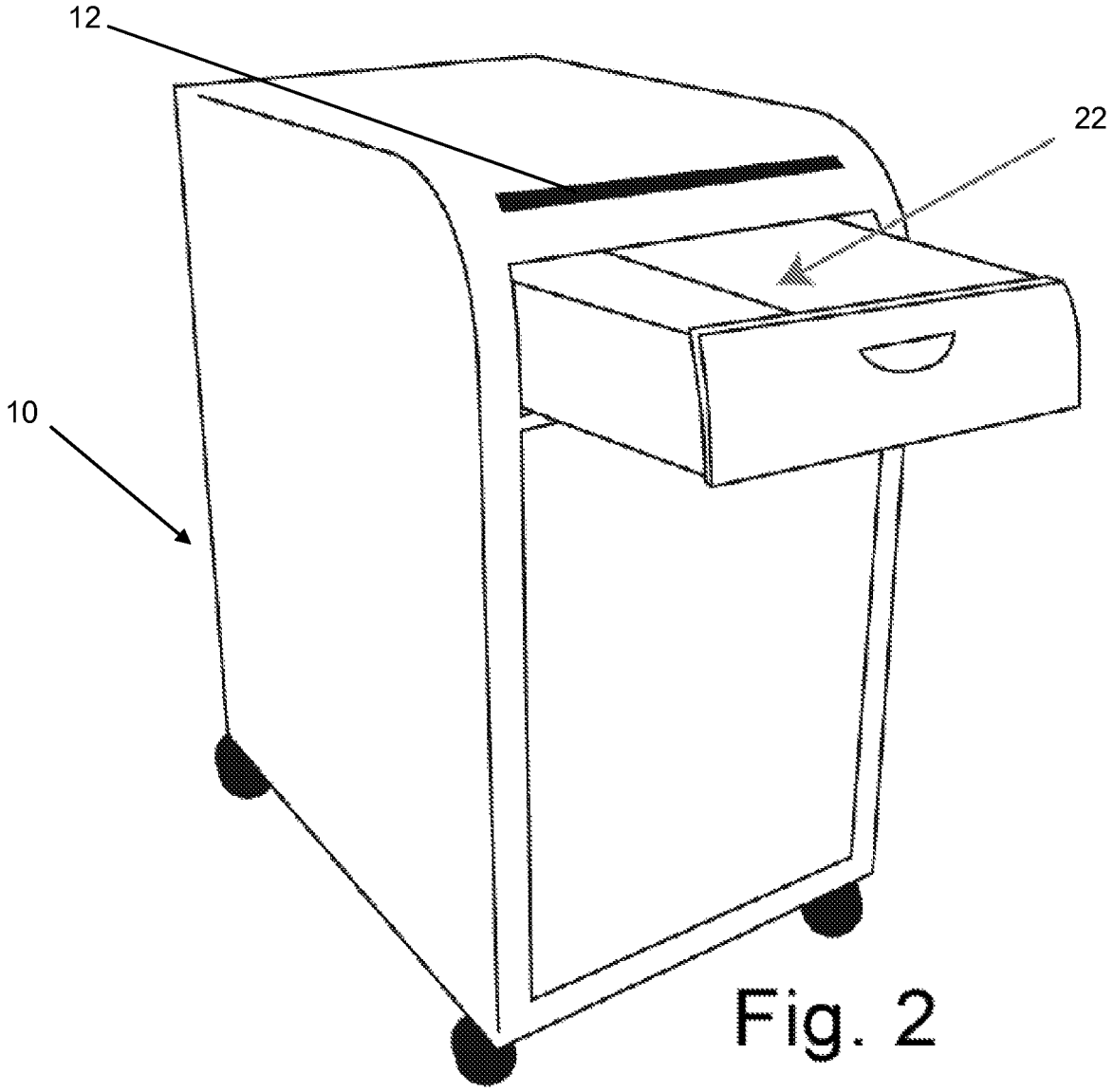
FIG. 2 shows a drawing of the current invention, an auto-feed shredder configured for placement below a desk surface.
Figure 3:
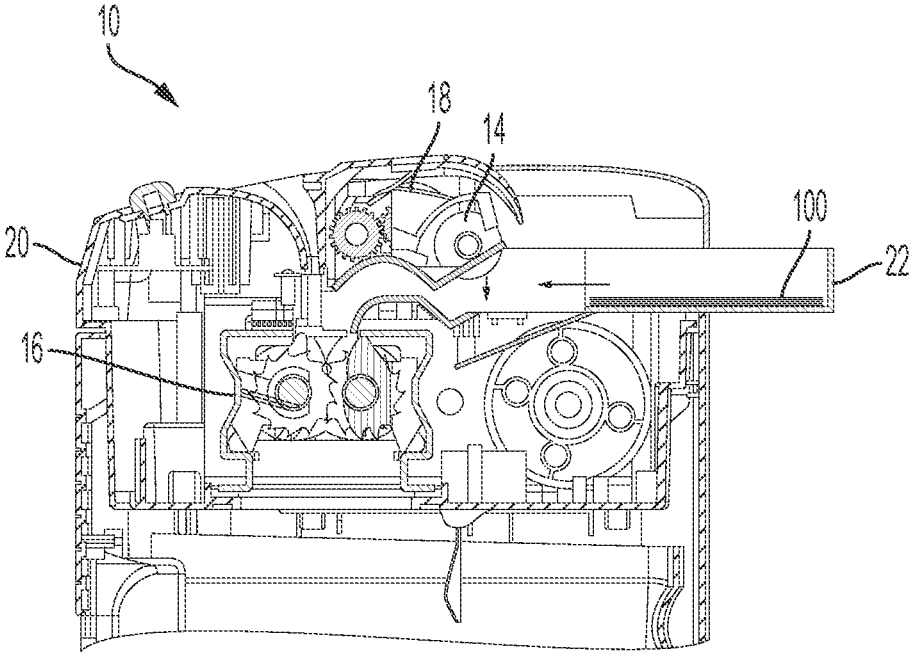
FIG. 3 shows a cross-sectional view of the shredder of FIG. 2 illustrating a top-feeding embodiment with at least one roller in an upper position, and a drawer in an open position.
Figure 4:
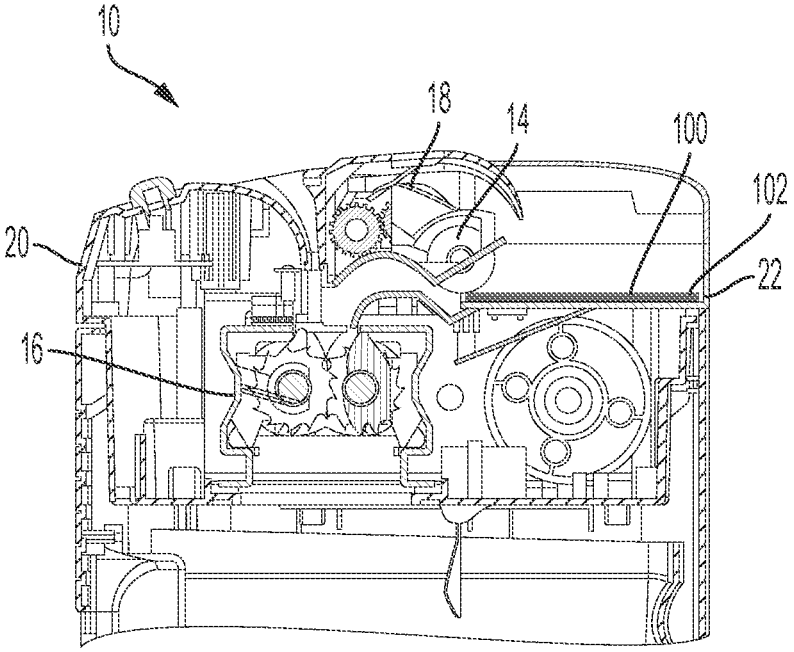
FIG. 4 shows a cross-sectional view of the shredder of FIG. 2 illustrating a top-feeding embodiment with a drawer in a closed position, and at least one roller in a lower position contacting an upper surface of a stack of paper.

The present invention enables an auto-feed shredder as has been described above to be conveniently be place below a desk surface. As shown in FIGS. 2-4, the device has an input slot 12 on the front surface, on a top bevel or near the front of the top so that when the unit is slid beneath a desk surface, the input slot is still accessible. Internally, the unit is much like a traditional shredder having a shredding mechanism 16 of spaced apart cutter blades disposed on two counter-rotating shafts disposed within a housing 20. A "throat" or chute conducts the paper sheets into the shredding mechanism 16 where they are shredded by the counter-rotating blades. In addition to the typical input slot 12, the unit has an input drawer 22 for inputting an entire stack of papers 100 to be processed by an auto-feed system 18. To use the drawer 22, it is slid out from the unit 10 and the stack of paper documents 100 is loaded into the drawer 22. Then, the drawer 22 is slid back into the unit 10, and the shredding commences. It will be appreciated that the input slot 12 can be above or below (or even feed directly into) the input drawer 22.

The drawer auto-feed 18 can operate in several different ways. In one top-feeding embodiment, the bottom interior surface of the tray is equipped with a biasing plate that becomes depressed when a stack of paper 100 is inserted into the drawer 22. Similar to the structure of paper trays in copiers and printers, when a stack of paper 100 is loaded into the tray, the spring-loaded biasing plate becomes depressed by the weight of the paper stack 100. When the user presses down to insert the stack 100, the biasing plate locks into place so that it no longer exerts upward force on the stack 100. When the drawer 22 is inserted into the shredder 10, the lock on the biasing plate is automatically released so that the biasing plate again exerts an upward force on the paper stack 100 thereby bring the paper into contact with a feed roller or belt 14 that draws single sheets of paper, one at a time, off the top of the stack 100 and feeds them into the throat of the shredding mechanism 16. Sheets of paper inserted through the input slot 12 move directly into the throat of the shredder 10 generally without assistance of the feed rollers 14. For that reason it is usually preferred to place the input slot 12 above the drawer 22 so that inserted sheets can feed directly into the throat. It will be appreciated that to allow the paper drawer 22 to be readily removed for reloading, the feed roller or feed belt 14 is located above the paper stack 100 in a position not to interfere with removal of the tray. During the paper feed cycle, the belt or roller 14 temporarily moves into position to contact the upper surface 102 of the paper stack 100.

Figure 5:
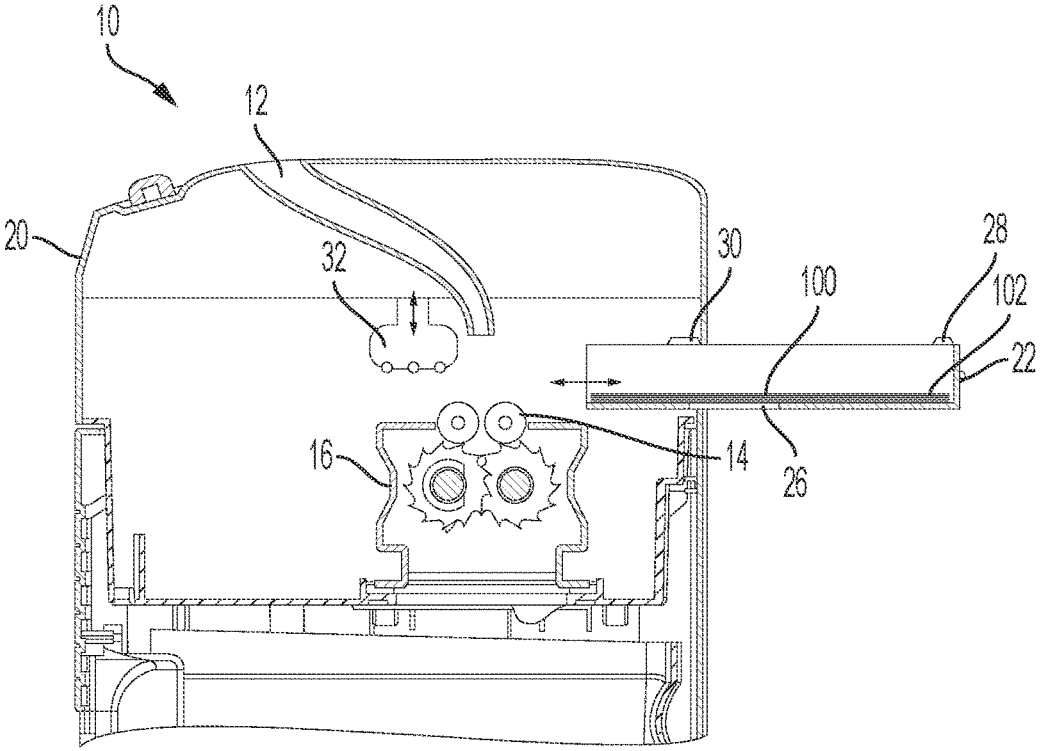
FIG. 5 shows a cross-sectional view of the shredder of FIG. 2 illustrating a bottom-feeding embodiment with at least one roller in a lower position, a pressure plate in a upper position, and a drawer in an open position.
Figure 6:
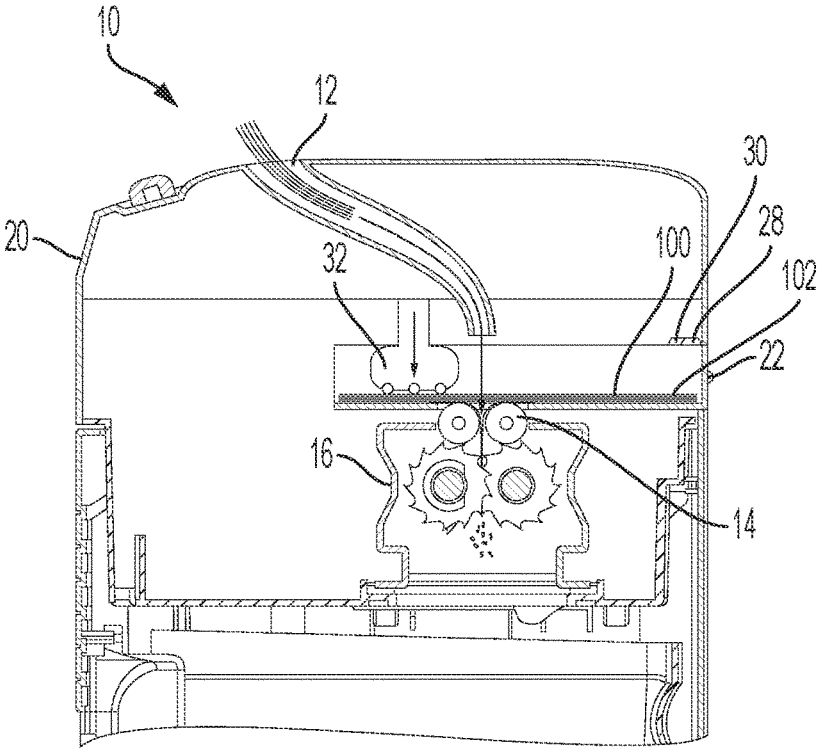
FIG. 6 shows a cross-sectional view of the shredder of FIG. 2 illustrating a bottom-feeding embodiment with a drawer in a closed position, at least one roller in an upper position extending into a slot in a bottom of the drawer and contacting a lower surface of a stack of paper, and a pressure plate in a lower position and contacting an upper surface of a stack of paper.

In an alternate bottom-feeding embodiment, seen in FIGS. 2, and 5-6, the drawer 22 has a slot 26 in its bottom though which the counter-rotating feed rollers 14 of the type disclosed in U.S. Pat. No. 8,074,912 pass to contact the bottom sheet of the stack 100 so as to "suck" sheets from the bottom of the stack and feed them into the shredder throat. A pair of belts moving in opposite directions can take the place of the rollers 14. The shredder is constructed so that when the feed rollers 14 are in an active contacting position, the drawer 22 is locked closed. When the feed rollers 14 are inactive, they retract and the drawer 22 unlocks so that it can be refilled. The locking of the drawer 22 can be automatic or under manual control. In a manual system, when the drawer 22 is inserted into the shredder 10, a catch 28 locks the drawer 22 in position and a sensor 30 is activated to determine if the drawer 22 contains paper. If it does contain paper, the feed rollers 14 move up into contact with the lower surface of the paper stack 100. When the user desires to withdraw the drawer 22 to insert additional paper, the user presses a switch or a lever that unlocks the catch 28 and simultaneously causes the feed rollers to retract allowing the drawer 22 to be withdrawn.

It will be appreciated that for such a bottom feed roller configuration to operate reliably, the drawer 22 must be equipped with means to uniformly press the stack down onto the feed rollers 14. This can be accomplished either by a spring-loaded, hinged bias plate under which the sheets of paper are placed when one loads the drawer 22 or by a mechanically driven pressure plate 32 that descends into the drawer 22 when it is inserted into the shredder. The same sensor 30 that controls movement of the feed rollers 14 could also control the mechanically driven pressure plate 32 so that like the feed rollers 14 (or moving belts), the pressure plate 32 automatically retracts when the drawer 22 is slid out for loading purposes. The input slot 12 is configured so that inserted sheets of paper are deflected to the feed rollers 14 when the drawer 22 is empty.

To review operation of an automatic bottom-feeding embodiment of the drawer loading under desk paper shredder 10: to shred a stack of documents 100, the input drawer 22 is slid out from the unit 10. In a preferred embodiment, the entire drawer 22 can be removed from the shredder 10 so that loading documents can be conveniently accomplished on the user's work desk. The drawer 22 is not unlike an input drawer for a copier, fax machine or printer. The drawer 22 is equipped with guides so the tray can be adjusted to accept paper stacks of several standard dimensions (e.g., letter, legal and A4). The drawer 22 has an opening slot 26 in its lower surface for the feed rollers 14. The drawer 22 is loaded with a stack of documents and slid back into the shredder 10. Assuming that the shredder 10 is set to "automatic" or "on" a sensor 30 determines whether or not there are documents in the drawer 22. If there are, the drawer 22 is locked and the feed rollers 14 ascend to make contact with the lower sheet of the paper stack 100. At the same time any upper surface pressure device 32 present activate to press the paper stack 100 into contact with the rollers 14. The rollers 14 then activate and sheets of paper are pulled from the bottom of the stack 100 and fed into the input throat of a shredding mechanism 16. A sensor in the throat detects the paper and starts the shredding mechanism. Shredding continues until the stack 100 is exhausted. When there is no more paper being fed into the input throat, the shredding mechanism 16 stops. The stack sensor 30 determines that the drawer 22 is empty so the feed rollers 14 deactivate and move downward and into a "safe" position (at the same time any upper surface pressure device 32 also withdraws) so that the drawer 22 can be opened for addition of more paper.

The following claims are thus to be understood to include what is specifically illustrated and described above, what is conceptually equivalent, what can be obviously substituted and also what incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. An auto-feed paper shredder configured to fit under a desktop comprising:

a housing containing a paper shredding mechanism;

an input slot on a surface of the housing disposed so that sheets of paper can be manually inserted when the auto-feed paper shredder is placed beneath a desktop;

a horizontally oriented, slidable drawer insertable into a front surface of the paper shredder for holding a stack of paper to be shredded; and an auto-feed apparatus configured to remove sheets of paper from a lower surface of the stack and convey the sheets to the paper shredding mechanism when the slidable drawer is inserted into the paper shredder; wherein the drawer includes a bottom slot through which the sheets pass to the paper shredding mechanism.

2. The auto-feed paper shredder according to claim 1, wherein the auto-feed apparatus comprises a pair of counter-rotating rollers or belts for removing sheets of paper from the lower surface of the stack.

3. The auto-feed paper shredder according to claim 2, wherein the auto-feed apparatus has an upper position wherein the pair of counter-rotating rollers or belts contacts the lower surface of the stack and a lower position wherein the pair of counter-rotating rollers or belts do not contact the lower surface of the stack to allow the drawer to be inserted into or removed from the paper shredder.

4. The auto-feed paper shredder according to claim 2 further comprising a sensor system for determining whether the slidable drawer contains paper when the slidable drawer is slid into the auto-feed paper shredder.

5. The auto-feed paper shredder according to claim 4, wherein the auto-feed apparatus is configured to move into the upper position when the slidable drawer contains paper.

6. The auto-feed paper shredder according to claim 2 further comprising a pressure device for applying downward pressure to the stack of paper.

7. An auto-feed paper shredder configured to fit under a desktop comprising:

a housing containing a paper shredding mechanism;

an input slot on a surface of the housing disposed so that sheets of paper can be manually inserted into the paper shredding mechanism when the auto-feed paper shredder is placed beneath a desktop; and a horizontally oriented, slidable drawer on a front surface for holding a stack of paper to be shredded; and an auto-feed apparatus comprising at least a pair of counter-rotating rollers or belts for removing sheets of paper from a lower surface of the stack and conveying the sheets to the paper shredding mechanism; wherein the drawer includes a bottom slot through which the sheets pass to the paper shredding mechanism.

8. The auto-feed paper shredder according to claim 7, wherein the auto-feed apparatus has an upper position wherein the pair of counter-rotating rollers or belts contacts the lower surface of the stack and a lower position wherein the pair of counter-rotating rollers or belts do not contact the lower surface of the stack to allow the drawer to be inserted into or removed from the paper shredder.

9. The auto-feed paper shredder according to claim 7 further comprising a sensor system for determining whether the slidable drawer contains paper when the slidable drawer is slid into the auto-feed paper shredder.

10. The auto-feed paper shredder according to claim 9, wherein the auto-feed apparatus is configured to move into the upper position when the slidable drawer contains paper.

11. The auto-feed paper shredder according to claim 7 further comprising a pressure device for applying downward pressure to the stack of paper.

* * * * *